US007007805B2

(12) United States Patent
Hughes

(10) Patent No.: US 7,007,805 B2
(45) Date of Patent: Mar. 7, 2006

(54) HYDROXAMATE COMPOSITION AND METHOD FOR FROTH FLOTATION

(75) Inventor: Terence Charles Hughes, North Carlton (AU)

(73) Assignee: Ausmelt Limited, Dandenong (AU)

( * ) Notice: Subject to any disclaimer, the term of this patent is extended or adjusted under 35 U.S.C. 154(b) by 0 days.

(21) Appl. No.: 10/764,758

(22) Filed: Jan. 26, 2004

(65) Prior Publication Data

US 2004/0211933 A1 Oct. 28, 2004

Related U.S. Application Data

(63) Continuation of application No. PCT/AU02/00994, filed on Jul. 27, 2001.

(30) Foreign Application Priority Data

Jul. 27, 2001 (AU) ..... PCT/AU01/00920

(51) Int. Cl.
*B03D 1/02* (2006.01)
*B03D 1/01* (2006.01)
*B03D 1/018* (2006.01)

(52) U.S. Cl. ..... 209/166; 252/61; 252/363.5; 562/621

(58) Field of Classification Search ..... 252/61, 252/363.5; 562/621; 209/166
See application file for complete search history.

(56) References Cited

U.S. PATENT DOCUMENTS

| | | | | | |
|---|---|---|---|---|---|
| 3,933,872 | A | * | 1/1976 | Hartlage | 562/621 |
| 4,214,983 | A | | 7/1980 | Rule | 209/166 |
| 4,324,654 | A | | 4/1982 | Rule | 209/166 |
| 4,629,556 | A | * | 12/1986 | Yoon et al. | 209/166 |
| 4,871,466 | A | * | 10/1989 | Wang et al. | 252/61 |
| 4,929,343 | A | * | 5/1990 | Wang et al. | 209/166 |
| 5,126,038 | A | | 6/1992 | Nagaraj | 209/166 |
| 5,237,079 | A | * | 8/1993 | Wang et al. | 554/103 |
| 5,635,023 | A | * | 6/1997 | Curtis | 162/5 |
| 5,685,899 | A | * | 11/1997 | Norris et al. | 106/487 |
| 6,145,667 | A | * | 11/2000 | Rothenberg et al. | 209/166 |
| 6,378,703 | B1 | * | 4/2002 | Mathur et al. | 209/166 |
| 6,739,454 | B1 | * | 5/2004 | Rothenberg et al. | 209/166 |
| 2004/0059156 | A1 | * | 3/2004 | Hughes | 562/621 |

FOREIGN PATENT DOCUMENTS

WO WO 02/10122 A1 2/2001

OTHER PUBLICATIONS

PCT International Search Report for PCT/AU02/00994 dated Aug. 06, 2002.
Derwent Abstract Accession No. 88-096046/14, class P83 JP 63-047767 A (Fuji Photo Film KK) Feb. 29, 1988 Abstract.
Derwent Abstract Accession No. 59178 E/28, classes E16, J01, M24, P41 SU 865397 (Ore Mech Proc Inst) Sep. 25, 1981.
Supplementary European Search Report dated Nov. 18, 2004 for Application No. EP 02 74 8454.
Assis, S.M., Montenegro, L.C.M., Peres, A.E.C.: "Utilisation of Hydroxamates in Minerals Froth Flotation", Minerals Engineering, vol. 9, No. 1, 1996, pp. 103-114, XP002306214 * p. 105; figure 2 *.

* cited by examiner

*Primary Examiner*—Joseph D. Anthony
(74) *Attorney, Agent, or Firm*—Norris McLaughlin & Marcus PA

(57) ABSTRACT

The invention relates to a hydroxamate composition for collection of minerals by froth flotation, the composition including an aqueous mixture of hydroxamate wherein the pH of the composition is at least 11 and a method of collecting mineral values from an aqueous ore slurry by froth flotation.

23 Claims, No Drawings

HYDROXAMATE COMPOSITION AND METHOD FOR FROTH FLOTATION

The present application is a continuation application filed under 35 U.S.C. 111(a) of PCT/AU02/00994.

The present invention relates to a hydroxamate composition and method of collection of minerals by froth flotation using hydroxamate.

BACKGROUND

Hydroxamic acids and their salts (hereinafter referred to as hydroxamates) are used in collection of minerals such as pyrochlore, muscovite, phosphorite, hematite, pyrolusite, rhodonite, rhodochrosite, chrysocolla, malachite, bornite, calcite, gold and other precious metals. Hydroxamates are particularly useful in froth flotation of copper minerals particularly oxidized copper minerals.

The hydroxamates used in collection of minerals generally comprise a hydrocarbyl group such as an aryl, an alkylaryl or a fatty aliphatic group. Hydroxamates may exist in a complex array of forms due to resonance conjugation such as the following:

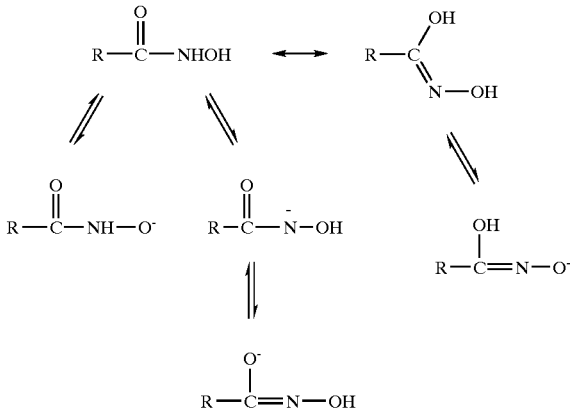

The presence of these forms and the relative concentrations may depend on the solvent, pH and presence of other compounds such as counter ions. Furthermore if restricted rotation about the C—N bond occurs then discrete Z and E isomers may also exist

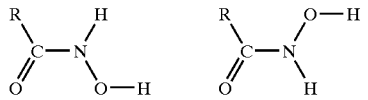

Z isomer E isomer

The structure of the hydroxamic acids in solution and the effect of isomerism on performance in froth flotation is not understood.

Processes have been described for the preparation of hydroxamates in the acid form. For example, Rothenberg U.S. Pat. No. 6,145,667 describes the preparation of hydroxamic acids as a solution in an oil or fatty alcohol. Our copending international application PCT/AU01/00920 describes preparations of fatty hydroxamates in the form of a solid salt such as the potassium or sodium salt. We have found that the use of the hydroxamate in an organic solvent or in acid or the dry form significantly reduces the activity of hydroxamate in froth flotation. We believe that this occurs as a result of a substantial portion of the acid or salt being present in an inactive form.

SUMMARY OF THE INVENTION

We have now found that the hydroxamate is provided in a form in which the activity in froth flotation is substantially improved if the hydroxamate is in the form of an aqueous mixture of pH of at least 11. Accordingly we provide a hydroxamate composition for collection of minerals by froth flotation comprising an aqueous mixture of hydroxamate wherein the pH of the composition is at least 11, preferably in the range of from 11 to 13, more preferably from 11.5 to 13 and most preferably from 12.0 to 12.5.

In a further aspect the invention provides a method of collecting mineral values from an aqueous ore by froth flotation, the method comprising the step of mixing the aqueous slurry of ore with an aqueous hydroxamate composition wherein the pH of the aqueous hydroxamate composition is at least 11.

We have found that the hydroxamate composition can contain free hydroxylamine, preferably no more than 1% which may act to stabilise the flotation reagent and maintain its performance over at least six months. Accordingly in preferred embodiments the invention provides a hydroxamate composition and method as hereinbefore defined wherein the hydroxamate composition comprises free hydroxylamine preferably in an amount of up to 1% by weight.

DESCRIPTION OF PREFERRED EMBODIMENTS

The hydroxamate composition of the invention is in the form of an alkaline aqueous mixture and may be an aqueous solution, a viscous slurry or paste. Preferably the concentration of the hydroxamate is in the range of from 1 to 60% by weight of the aqueous mixture and preferably from 5 to 50% and most preferably from 5 to 30%.

The hydroxamate composition is preferably essentially free of water insoluble solvents such as fatty alcohols. The compositions may comprise a small amount of fatty acid impurity but the amount is preferably less than 5% by weight of the hydroxamate and preferably no more than 2% by weight.

The hydroxamate composition may comprise a small amount, preferably no more than 3% by weight of an antifoaming agent such as methanol or ethanol. Such an antifoaming agent may be used to reduce foaming during preparation of the hydroxamate as disclosed in International Application PCT/AU01/00920.

The hydroxamate in the composition of the invention is preferably a fatty hydroxamate and typically the fatty portion has a carbon chain length in the range of from 6 to 14 carbon atoms, preferably from 8 to 12 carbon atoms and most preferably $C_8$, $C_{10}$ or mixture thereof.

We have found that $C_8$ fatty carbon chain gives the best flotation performance in the composition of the invention. The reagent based on $C_6$ has good water solubility but is less effective. The reagent based on $C_{12}$ is also less effective in froth flotation but may be useful in some circumstances.

Suitable $C_8/C_{10}$ fatty acids or their derivatives for use in preparation of the preferred fatty alkyl portion of the hydroxamate may be sourced from fractionated coconut and palm kernel oil.

Short chain aliphatic mono carboxylic acids may also be sourced from the petroleum industry e.g. 3,5,5 trimethyl hexanoic acid.

The fatty hydroxamate composition of the invention has a pH of 11 to 13 and preferably 11.5 to 13 and most preferably 12.0 to 12.5. At such pH the hydroxamate will be present as a salt. Preferably the counter ion present in the salt is selected from alkali metals, particularly sodium, potassium or a mixture of sodium and potassium. Potassium is the most preferred counter ion.

Preferably the counter ion is present in excess. It may for example be provided by addition of alkali metal base such as a potassium hydroxide, sodium hydroxide or a mixture thereof.

We believe the high pH (particularly where the hydroxamate is the potassium salt of a ($C_6$–$C_{12}$ fatty alkyl hydroxamate) facilitates formation of a more active form of the hydroxamate. We believe the more active form is the cis-enol form of the hydroxamate anion which may be represented by formula:

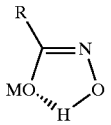

wherein M is the metal ion such as sodium or potassium and R is hydrocarbyl particularly $C_6$ to $C_{14}$ fatty alkyl. The aqueous slurry of the alkali metal fatty hydroxamate of pH 11.5 to 13 is more active than the solid fatty hydroxamate. When the alkali metal hydroxamate is evaporated to incipient dryness it appears that it forms an aggregate between hydroxamic acid resulting in an alkali metal content almost half of the expected value. It may be that the dried or concentrated paste product forms an aggregate of formula

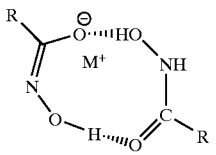

The froth flotation activity of this solid salt can generally be restored by addition of alkali metal hydroxide to provide a pH of 11.5 and preferably 12–12.5.

The composition of the invention may be used in froth flotation of metal oxides or carbonates such as cassiterite, cuprite, chrysocolla, cerussite, smithsonite, atacamite, malachite, wolframite and scheelite. The composition of the invention may be used with other mineral collectors such as xanthates, organothiophosphates or thionocarbamates. The composition of the invention may also be used in recovery of metallic copper, silver, gold and platinum group metals by froth flotation. When used together in flotation with a sulphide collector a synergistic interaction results in the improved rapid recovery due to collection of both sulphide and oxide minerals simultaneously.

The composition of the invention may also comprise or be used with a dialkyldithiocarbamate. As described in our copending Australian provisional patent application lodged on 27 May 2002, we have found that dialkyldithiocarbamates improve the efficiency of recovery of minerals in highly oxidized ore.

The composition of the invention may be formulated as a concentrated slurry such as a paste for transport. Such a paste may comprise 30 to 50% by weight of alkali metal hydroxamate and 50 to 70% water and optionally other components. Such a concentrate may be used in froth flotation but it may be diluted prior to use by addition, for example, of dilute alkali such as alkali metal hydroxide (e.g. 0.5% KOH). It is preferred that the hydroxamate slurry is diluted to essentially dissolve the hydroxamate, optionally with mild heating (for example to 30 to 50° C.). The diluted composition for addition to the flotation cell may comprise 1 to 30% preferably 1 to 15% by weight alkali metal hydroxamate. The hydroxamate is preferably diluted with alkali metal hydroxides and mixed for preferably 15 to 30 minutes before being added to the flotation cell. The hydroxamate, alkali metal solution should preferably be prepared fresh each day if shipped on the aqueous paste or solid form.

In a preferred embodiment the invention provides a method of froth flotation of minerals from ore comprising:

(i) forming an aqueous slurry of the ore;

(ii) optionally adjusting the pH of the slurry;

(iii) adding to the slurry an aqueous composition of fatty hydroxamate of pH of at least 11, as hereinbefore described;

(iv) preferably agitating the slurry to mix and condition the fatty hydroxamate and ore slurry, (a sulphide flotation reagent can be added if sulphides are to be removed together with the oxidised minerals);

(v) adding a frothing agent to the slurry;

(vi) agitating the slurry to form a froth containing floated minerals; and (vii) removing the froth and collecting the floated minerals in the presence of the hydroxamate.

The concentration of hydroxamate as judged by the UV-visible method, is typically in the range of 10–1000 mg per liter depending upon the grade and amount of ore and the metals of interest. In terms of the quantity of ore the amount of hydroxamate reagent is generally in the range of 0.1 to 500 g/tonne.

We have found that the efficiency of the hydroxamate reagent in recovery of particulate metals by the flotation method is dependent upon pH. Recovery of copper and many other metals is enhanced when the pH of the flotation liquor is in the vicinity of or about the pKa of the Bronstead acid which is the fatty hydroxamic acid. The working pH may be higher than the pKa (ca. 9). The recovery of copper using hydroxamate is enhanced significantly when the pH of the ore slurry is at least about 8.5 and more preferably from 8.5 to 13, most preferably 10 to 13.

The hydroxamate composition of the invention is also found to be an effective collector at pH well below that of its pKa. As for instance, it recovers tin cassiterite ($SnO_2$) at optimum pH from 4 to 5. In this instance, the reagent might have a relatively less solubility, however, as far our structural analysis the reagent functionality should still be accessible in reactive chelating mode. It is possible the zeta potential of tin mineral (~4.5) induced hydroxamate adsorption process in a faster rate at lower pH. Since the hydroxamate reagent has limited solubility at pH 4–5 it is not able to form the reactive aggregate as it occurred at higher pH in the case copper recovery. It is found that with increasing temperature from 20 to 30° C. there is a significant improvement in the tin recovery process which may be offset in part by increasing the more soluble C-6 content of hydroxamate. Generally increasing the temperature increases the grade and recovery of the flotation process.

The hydroxamate reagent of the invention is adsorbed on the oxidised mineral surface in the flotation cell, very rapidly (within milli secs) and the compositions of the invention provides excellent flotation performance presumably because the reagent is present in the active cis-enolate form.

The presence of unreacted methyl ester or hydrolysed fatty acid products are detrimental to flotation performance in terms of flotation specificity and yield. It has been noted that ozone or hydrogen peroxide are ideal additions to the flotation cell prior to the addition of hydroxamate solution. In practice $O_3$ is most useful as a rapid and powerful oxidising agent to ensure that particular mineral phases are selectively oxidised without leaving any added cations or anions to the slurry.

The hydroxamate composition of the invention may be prepared by increasing the pH of hydroxamates prepared by process known in the art. For example, in one embodiment a fatty acid derivative such as a lower alkyl (eg methyl or ethyl ester of a $C_6$ to $C_{14}$ fatty acid is reacted with hydroxylamine in aqueous solution. The hydroxylamine may be formed in situ from hydroxylamine salts in the presence of an alkaline aqueous solution which is typically an aqueous solution of alkali metal hydroxide.

In a preferred embodiment hydroxylamine is prepared at a concentration of 10 to 30% w/v by reaction between alkali metal hydroxide and hydroxylammonium sulfate.

It is preferred that the reaction is conducted in aqueous solution and the amount of water is controlled to provide a concentration of product in the range of from 30 to 50% w/v. It is preferred that the reaction mixture is essentially free of water insoluble solvents and surfactants. The fatty acid ester reagent used to form the hydroxamate is water immiscible however we have found that it reacts with the hydroxylamine in aqueous solution and during the process of the reaction the aqueous and fatty acid ester phases merge, possibly due to the emulsifying characteristics of the initially formed hydroxamate. The pH of the composition is adjusted by addition of alkali such as alkali metal hydroxide to provide a pH preferably of at least 11 and preferably 12 to 12.5.

If the alkali metal fatty hydroxamate is prepared as a dry solid we have found, as discussed above, that activity is lost presumably through formation of the inactive form. Activity may be provided in accordance with the invention by adding aqueous alkali, particularly potassium or sodium hydroxide to provide an aqueous mixture of the solid of pH of at least 11.

The invention will now be described with reference to the following examples. It is to be understood that the examples are provided by way of illustration of the invention and that they are in no way limiting to the scope of the invention.

EXAMPLES

Where referred to in the Examples pH measurement was carried out using a combination glass electrode. The specific brand used was ORION model 42 a pH measuring system using combination glass electrode type 9107. Combination glass electrodes of other brands may similarly be used in pH determination.

Example 1

Part (a)

This examples demonstrates the preparation of a composition of the invention containing potassium salt of ($C_8/C_{10}$ fatty alkyl)hydroxamate without isolating the solid salt.

Hydroxylamine sulfate is reacted with potassium hydroxide to produce hydroxylamine free base at a concentration of 15–16% by weight. The potassium sulfate formed as a by product is removed by filtration.

The hydroxylamine free base is then added and mixed continuously with the methyl ester of $C_8/C_{10}$ fractionated fatty acids derived from coconut or palm oil keeping the temperature under 40–45° C. An excess of hydroxylamine free base (approximately 1.25 molar excess) is used to drive the reaction to completion.

A small stoichiometric excess of potassium hydroxide is added to form the potassium ($C_8/C_{10}$ fatty) hydroxamate as 45% w/v paste having a pH of about 12 to 12.5.

Part (b)

This part demonstrates the preparation of a solid potassium salt of $C_8/C_{10}$ hydroxamate derivatives from coconut oil and its use in preparing hydroxamate compositions of the invention.

A 7–8% free hydroxylamine reagent was generated by following a procedure similar to than in Example 1. It was then immediately reacted with triglyceride of coconut oil (22.5 g, saponification value 279, 0.112 mole equivalent of glyceride) at 45° C., under agitation. After a stirring period of 12 hours the white, creamy material was transferred to a pyrex bowl and was exposed to air to allow the solvent to gradually evaporate to dryness. The resultant white, paste product was subjected to washing with cold methanol to remove glycerol and other organic materials. The FTIR spectrum of dry white powder (18 g) showed an absorption band similar to that of the potassium salt of $C_8/C_{10}$ hydroxamate derivative made in Example 1 of PCT AU01/00920.

The fatty hydroxamate composition of the invention may be prepared by dispersing the solid hydroxamate in warm 1% potassium hydroxide solution and preferably stirring for at least 15 minutes.

Example 2

Production Formulation

A two (2) tonne batch of hydroxamate was prepared using a 1000L capacity reactor and the following steps:

- 150 kg water was placed in 1000L glass reactor.
- 175 kg $(NH_3OH)_2SO_4$ was added and mixing started.
- 245 kg 49% KOH is manually added to the reactor at a rate such that the reactor temperature never exceeds 35° C.
- The above caustic addition was continued over a 6–8 hour period.
- The hydroxylamine slurry was discharged from the reactor through a bottom valve.
- The solution of hydroxylamine is separated from the $K_2SO_4$ slurry using a filter bag under suction.
- 317.6 kg weight $NH_2OH$ solution is recovered by filtration in which $NH_2OH$ content is measured to be 15.75%.
- The resulting $NH_2OH$ free base solution from above is taken back to the 1000 L reactor to start the hydroxamate reaction.
- 203 kg methyl ester is added to the hydroxylamine solution.
- 74 kg 92% KOH flakes is gradually introduced into the reactor with a view to control the reactor temperature.
- When 50% caustic potash is introduced a white foamy product starts building up in the reactor.
- The reactor temperature after 50% caustic addition rose to about 42° C.

When 2/3 addition of KOH is completed the temperature further rose to 48° C.

Upon addition to the remainder KOH in 7 hour period the reactor temperature remained steady at 50° C.

Bright white foamy hydroxamate product material almost fully occupies the reactor space.

Example 2a

This example demonstrates the influence of (a) the pH of an aqueous solution of potassium fatty alkyl hydroxamate and (b) the flotation cell pH on recovery of coppers.

The Copper Ore

The copper ore was prepared for the flotation cell from the ore composition shown in the following table 1:

TABLE 1

| Feedstock and Metal Content | |
|---|---|
| Oxidised Cu ore (North Parkes, NSW) | Cu 0.8%<br>Au 0.9 ppm |

1 kg samples of the mineral feedstock were ground to 80% less than 75 $\mu$m and was subjected to standard flotation methods in a 2 liter laboratory flotation cell.

Fatty Hydroxamate

Fatty hydroxamate prepared according to the method of Example 2 after adjusting the pH to that shown in Table 1.

Five samples of the hydroxamate were prepared and dissolved in warm water and the pH adjusted with addition of aqueous KOH where necessary.

The flotation cell was prepared by slurrying the crushed ore and adjusting the pH of the flotation cell with aqueous KOH.

The tests shown in the table below were carried out using methyl isobutyl carbinol as the flotation agent (up to 10 g/tonne). The composition of the froth concentrate under the pH conditions and hydroxamate dosage shown in the table are also listed.

A significant improvement in recovery and flotation grade is observed when the hydroxamate is added to the flotation cell as an aqueous solution of pH over 11.

Example 3

This example examines the storage stability of the fatty hydroxamate of Example 1. It was found that the storage stability of the hydroxamate composition of Example 1 over a period of four months is significantly improved by the presence of about 0.3 to 0.6% by weight of hydroxylamine based on the weight of the aqueous composition.

Example 4

The potassium fatty alkyl hydroxamate composition according to the invention is believed to exist with the hydroxamate predominantly in cis-enolate type of geometrical isomeric form stabilized by resonance shown below.

$^{13}$C NMR studies indicate that upon protonation of the potassium fatty hydroxamate reagent the hydroxamate carbonyl carbon shifts 2 ppm to lower field (172 ppm to 174 ppm). Although this gives information about the negative charge localised on the hydroxamate functionality it does not provide evidence about which structural isomers are existing in the mixture.

To understand the isomeric structural equilibration, suberohydroxamic acid was chosen as a model compound. It is an 8-carbon containing di-hydroxamic acid molecule and because of symmetry the NMR spectra is both simplified and enhanced at the same time for the hydroxamate moity. Proton NMR of the compound when run in the solvent DMSO-$d_6$ shows clearly the two isomeric structures in the mixture. Hydroxamic acid —NHOH moiety protons provide strong evidence of the existence of two isomeric form. Compared with literature data on proton NMR of acetohydroxamic ($CH_3CONHOH$) acid it seems apparent that signals at the extremely low fields 10.93 and 10.31 ppm respectively are due to N—H protons of the cis and trans isomer.

TABLE 2

Flotation results using fatty oxidised Copper Ore from North Parkes Mine, NSW.

| Test No. | Flotation Cell pH | Hydroxamate Composition pH | Total Hydroxamate (g hydroxamate salt per tonne ore) | Flotation Product Cu grade | Flotation Product Cu Recovery | Flotation Product Au grade (ppm) | Flotation Product Au Recovery (ppm) |
|---|---|---|---|---|---|---|---|
| 1 | 7.5 | 8.5 | 230 | 9.8% | 39.1% | 5.5 | 27.5 |
| 2 | 8.5 | 8.5 | 230 | 12.5% | 49.2% | 7.5 | 33.5 |
| 3 | 9.5 | 10.2 | 150 | 17.4% | 61.0% | 8.5 | 42.5 |
| 4 | 10.1 | 11.1 | 100 | 29.2% | 64.2% | 10.5 | 55.5 |
| 5 | 11.5 | 11.1 | 80 g | 37.5% | 65.3% | 12.0 | 60.0 |

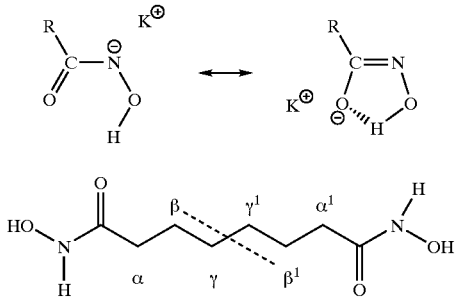

Suberohyroxamic acid
($C_2$ Symmetry)

Assignment of the Spectrum attached.

| Protons | Chemical Shift (δ ppm) |
|---|---|
| $\alpha\alpha^1$ | 2.5 (t, $J_{H.H}$ = 8 HZ) |
| $\beta\beta^1$ | 2.02 (m) |
| $\gamma\gamma^1$ | 1.78 (m) |
| cis N—H | 10.93 (s) |
| trans N—H | 10.31 (s) |
| cis O—H | 9.25 (s) |
| trans O—H | 9.60 (s) |

Following N—H proton signals there are two signals at 9.60 and 9.25 ppm which is assigned due to —OH proton attributed to trans and cis geometric form. Proton intensity measurement indicates that the ratio of cis:trans is 9:1.

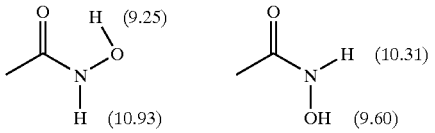

cis trans

Example 5

Fatty hydroxamate salts are often represented as salts of hydroxamic acid resulting from deprotonation with a strong base. Fatty hydroxamate salt structure has never been well characterised by modern analytical tools other than some putative resonance representation as shown in Scheme 1.

Scheme 1

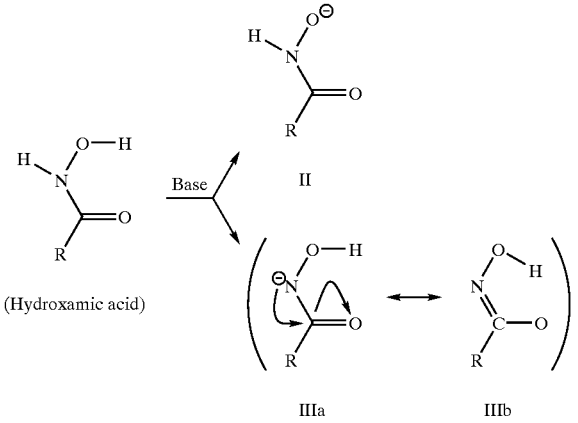

(Hydroxamic acid)

Deprotonation of the —OH site leads to structure II that cannot be resonance stabilised, however this can occur through the deprotonation of the NH site which leads to structure IIa and IIIb. Structure II might be called an hydroxamate whilst IIIb has a great deal of similarity with oxime structure and hence it might be ascribed as hydroximate. Whether structure II and III are interconvertible species and have any effect on bonding mode with metal is not known, however the resonance stabilisation which can occur with IIa and IIIb leading to the hydroxamate ion formation fits the prosed dimer (50% K content) model whereas this structure II does not.

The structures of the fatty hydroxamate in the composition of the invention were studied by Fourier transform infra red spectroscopy (FTIR), electron spray mass spectrometer (ESMS), thermal gravimetric analysis (TGA), nuclear magnetic resonance (NMR), and elemental analysis and correlate its activity in relation to flotation performance results.

The product of Example 1 is analysed by ATR-FTIR to see the functional group existence in the product. The important feature is found in the spectrum that methyl ester carbonyl signal at 1740 $cm^{-1}$ is totally replaced by the very intense signal at 1626 $cm^{-1}$ accompanied by two other distinctive signals appearing in the region of 1550 and 3212 $cm^{-1}$. Comparing with the spectrum of hexyl, octyl, decyl and dodecyl hydroxamate potassium salt prepared by synthetic procedure involving hydroxylamine hydrochloride, potassium hydroxide and methyl ester in anhydrous methanol, the hydroxamate product shows a very great deal of similarity in FTIR data as summarised in table 3.

TABLE 3

Selected FTIR data of various alkyl hydroxamate and their Comparison with hydroxamate reagent

| Hydroxamate sat in potassium form | Sampling Procedure | FTIR Signals ($cm^{-1}$) |
|---|---|---|
| Hexyl hydroxamate | In KBr | 3213, 1631, 1552 |
| Octyl hydroxamate | In KBr | 3213, 1626, 1555 |
| Decyl hydroxamate | In KBr | 3214, 1626, 1555 |
| Dodecyl hydroxamate | In KBr | 3212, 1626, 1563 |
| Hydroxamate reagent (in paste form) | Run in ATR-FTIR | 3213, 1627, 1554 |
| Hydroxamate reagent (in solid form) | In KBR | 3215, 1623, 1557 |

Upon controlled acidification, the hydroxamic acid product becomes less soluble in water but very soluble in organic media like alcohols and hydrocarbons. It shows FTIR signal features (in solid state) in which an intense additional signal is found at 1660 $cm^{-1}$. The signal appears originally at 3213 $cm^{-1}$ is now shifted more than 40 $cm^{-1}$ to the higher frequency region. Comparison of FTIR data between hydroxamate salt and the corresponding acidified product is summarised in Table 4.

TABLE 4

Comparison of FTIR data between hydroxamate salt and its acidified product

| Hydroxamate salt and its acidified product | Sampling Procedure | FTIR Signals ($cm^{-1}$) |
|---|---|---|
| Hexyl hydroxamate | In KBr | 3213, — 1631 1552 |
| Acidified product | In KBr | 3258, 1665 1629 1565 |
| Octyl hydroxamate | In KBr | 3213, — 1626 1555 |
| Acidified product | In KBr | 3260, 1665 1626 1566 |

TABLE 4-continued

Comparison of FTIR data between hydroxamate salt and its acidified product

| Hydroxamate salt and its acidified product | Sampling Procedure | FTIR Signals ($cm^{-1}$) |
|---|---|---|
| Decyl hydroxamate | In KBr | 3214, — 1626 1555 |
| Acidified product | In KBr | 3258, 1664 1623 1567 |
| Dodecyl hydroxamate | In KBr | 3215, — 1623 1557 |
| Acidified product | In KBr | 3257, 1664 1623 1567 |
| Hydroxamate reagent | Run in ATR-FTIR | 3213, — 1627 1554 |
| Acidified product | ART-FTIR | 3258, 1662 1620 1567 |

The FTIR spectral features reveal that the product is in fact distributed in two isomeric forms namely keto and enol forms, and their proportion can be greatly influenced by carbon chain length, pH of the media as well the zeta potential of the mineral particles. The keto form is mainly contributed by non-conjugated fatty hydroxamic acid in which carbonyl group absorbs at a higher frequency (1660 $cm^{-1}$) than the enol isomer as depicted in Scheme 2.

Scheme 2

AM2/Hydroxamate salt

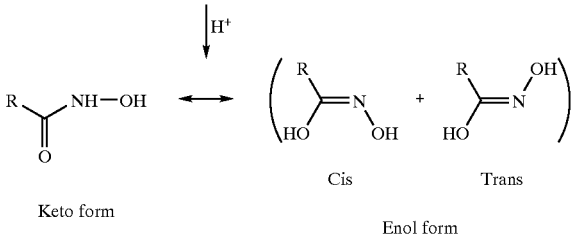

Fatty hydroxamic acid can also take the shape of conjugated enol form by delocalisation of nitrogen lone pair electron through carbonyl π bond which causes a shifting of the carbonyl absorption to lower energy (1626 $cm^{-1}$). Whilst in the enol form it can exist in both cis and trans geometric isomers. In the hydroxamic acid keto form, the —OH group bound to nitrogen appears in the higher frequency region (3258 $cm^{-1}$). As the conjugation of the system is increased it shifts the —OH vibration frequency to a lower energy as it found in hydroxamate salt or hydroxamate spectrum (3215 $cm^{-1}$) due to the likelihood of intramolecular H-bonding through preferential formation of cis-isomer. A similar electronic arrangement can cause N—H bending spreading through the region between 1550–1565 $cm^{-1}$.

In the composition of Example 1, the enol form dominates because of proton abstraction by KOH already present in the formulation. The FTIR therefore supports evidence portraying the hydroxamate salt as preferentially existing in enol form in the composition of the invention. In other words, the hydroxamate salt structurally more resembles a hydroximate than a hydroxamate as hypothesised in Scheme 1.

NMR analysis of the product of Example 1 reveals structural information which generally compliments the FTIR observations. FTIR gives mainly functional group information whereas NMR examines the whole molecular structure including the carbon framework. The NMR spectrum is run in liquid phase preferably in a protic solvent media simulating its practical use in flotation application. A solvent system comprising $D_2O/CD_3OD$ is found to be closely match combination to receive data on proton and carbon NMR of the potassium fatty hydroxamate.

The comparison of the NMR proton and carbon spectrum with the model octyl hydroxamate spectra shows very similar features in terms of proton and carbon chemical shifts. In proton NMR there are distinctly 4 sets of signals appearing in the region of 2.79, 2.33, 2.0 and 1.63 ppm as a triplet, quintet, broad multiplet followed by a second triplet attributed to straight fatty carbon chain protons. The triplet signal centred at 2.79 ppm is assigned to α-proton signal adjacent to carbonyl moiety. When the pH of NMR solution is brought down from alkaline to acidic region, the proton signal at 2.79 ppm is shifted to 0.2 ppm to down field. In the carbon spectrum this acidic treatment causes a carbonyl carbon signal shift from 172 to 174 ppm, which is 2 ppm shift to lower field. This NMR spectral feature is indicative of the hydroxamate having a negatively charged form possibly as hydroxamate form. Whilst running the NMR spectrum in protic media whether in acidic or alkaline conditions there seems to be always one dominant isomer in the mixture. In light of literature information based on NMR, X-ray crystal structure and ab intio molecular orbital calculations on analysis of lower hydroxamic acid molecule, it appears that the hydroxamate in protic solvent have hydroxamate type of structure with preference to cis-isomer which is energetically stable by hydrogen bonding with water molecule as shown in

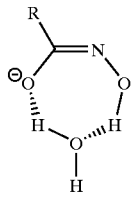

FIG. 1.

FIG. 1: Hydroxamate in Hydrated Form

The electrospray mass spectroscopic analysis of the hydroxamate and related alkyl hydroxamate salt when carried out in negative mode shows an intense negative ion peak that corresponds to mass peak (m/z) due to $[RCONOH]^-$ ion. Table 3 summarises the important mass peak which strongly supports the fact that hydroxamate as a salt is energetically stable and it shows two intense mass signals at 158 and 186, corresponding well with compositions comprised of $C_8$ and $C_{10}$ hydroxamate structures. The mass peaks in the hydroxamate sample is further verified by running pure $C_8$ and $C_{10}$ hydroxamate salts under identical manner.

TABLE 5

Electrospray mass spectral characterisation of hydroxamate salts and hydroxamate reagent run in negative ion mode (Example 1 Hydroxamate salt) $\xrightarrow{ES^-}$ Mass peak (m/z) correspond to $[RCONOH]^-$ ion

| Hydroxamate/ Hydroxamate salt | Abundant Peak (m/z) | Correspond to Mass |
|---|---|---|
| $C_8/C_{10}$ hydroxamate | 158 | $[C_7H_{15}CONOH]^-$ (C8) |
| | 186 | $[C_9H_{19}CONOH]^-$ (C10) |
| Octyl hydroxamate | 158 | $[C_7H_{15}CONOH]^-$ |
| Decyl hydroxamate | 186 | $[C_9H_{19}CONOH]^-$ |

In light of the reported spectroscopic evidence the hydroxamate in the composition partly exists in the form of enolate or hydroxamate structure and as such resembles the intermediate postulated in Hofmann rearrangement reaction. Hofmann rearrangement converts an amide into an amine with a carbon number less in one unit through the formation of isocyanate and its subsequent hydrolysis. When heated above 120° C. the hydroxamate product, undergoes rapid decomposition. This has been shown by thermal gravimetric analysis (TGA) and differential scanning calorimetry (DSC) techniques. The analysis of decomposition product by mass spectroscopy indicates that it is a mixture of amines mainly heptyl and nonyl composition. A similar thermal fragmentation is also displayed by octyl and decyl hydroxamate salt and these results are strongly indicative that hydroxamate to some extent has structural similarity as Hofmann intermediate as illustrated in Scheme 3.

When the hydroxamate product is solidified by slow evaporation of moisture it shows a great affinity to form aggregate between hydroxamic acid and the corresponding potassium salt. The potassium content assay in hexyl, octyl, decyl and dodecyl hydroxamate salt, (as shown by ICP assay is presented in Table 6) and shows that potassium level in all these salts is almost 50% less than the expected value. This elemental analytical assay indicates that in the solid state or paste form it most likely exists as an aggregate between salt and acid assisted by inter molecular hydrogen bonding, as it shown pairing through cyclic type of structure in FIG. 2.

The aggregation between salt and acid forms of hydroxamate is further evidenced from C, H and N content analysis carried out on the potassium octylhydroxamate compound. The theoretical C, H and N percentage value based on $C_7H_{15}CONOHK$ composition is expected to 48.13%, 8.18% and 7.1% respectively. However, the observed result based on combustion analysis gives value of 55.15%, 10.43% and 7.83% for C, H and N which agrees with the composition comprising 50:50 salt and acid forms together.

Scheme 3

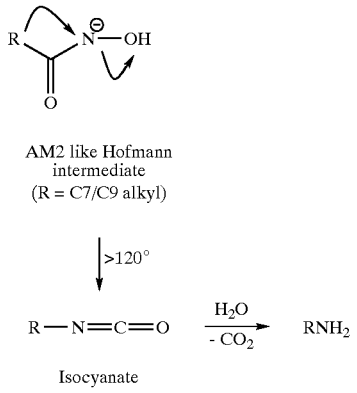

TABLE 6

Potassium level in hydroxamate salts assayed by ICP-OES method

| Hydroxamate Salt | K content (%) Measured | K content (%) Expected |
|---|---|---|
| Potassium hexyl hydroxamate | 11.2 | 23.1 |
| Potassium octyl hydroxamate | 10.2 | 19.8 |

TABLE 6-continued

Potassium level in hydroxamate salts assayed by ICP-OES method

| Hydroxamate Salt | K content (%) Measured | K content (%) Expected |
|---|---|---|
| Potassium dectyl hydroxamate | 8.3 | 17.4 |
| Potassium dodecyl hydroxamate | 8.6 | 15.4 |
| Hydroxamate reagent (solid form) | 9.2 | 19.0 |

The aggregate might be polymeric in nature through an extensive H-bonding network.

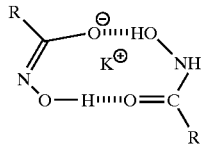

FIG. 2: Cyclic Structure Pairing Between Acid and Salt Form

In light of above characterisation data, it seems that the hydroxamate has a structural identity as following:

- Formed as a potassium salt of fatty hydroxamic acid comprising fatty carbon chain mainly $C_8$ and $C_{10}$ composition.
- The salt is thermally stable in air up to about 120° C. and shows decomposition pattern like an Hofmann intermediate.
- The salt form shows preference to adapt enolate type of structure and as such resembles an oxime.
- The salt upon acidification or dilution turns to fatty hydroxamic acid.
- Fatty hydroxamic acid has a part (resonance) structure similar to the enol form of the salt.
- The salt depending upon concentration and pH might be in equilibrium with its conjugate acid.
- Upon solidification the salt shows tendency to form aggregate by pairing with conjugate acid.

Upon investigating the fatty carbon chain from $C_6$ to $C_{18}$, it is experimentally found that when the reagent is exclusively made from $C_8$ it gives the best flotation performance due to optimum balance between structural factors such as keto-enol isomerisation and hydrophobicity factor. The reagent based on $C_6$ has a good solubility but is less effective due to shorter chain length. The reagent based on $C_{12}$ and above shows little solubility, as a result, although they are abundantly available from natural source they have limited use in mineral flotation.

In the formation of the hydroxamate, which is based on natural $C_8/C_{10}$ composition, as is sourced from fractioned coconut and palm kernel oil, there is optimal balance exist between structural factors such as keto-enol isomerisation and hydrophobicity.

The hydroxamate reagent when prepared as a paste form containing KOH is ready-to-use straight into the flotation circuit by simply dispersing into warm water.

Its hydrophobic part assists in flotation while its hydroxamate part assists in selective binding on metal surface by chelation mode.

When the hydroxamate reagent is suspended in water its hydrophobic carbon tail by virtue of Van der Waal force of attraction is likely to form a hemimicelle type of aggregate, in which the polar hydroxamate end group probably tends to orient in a circular type of arrangement. Such aggregates can be formed through the combination of ion-ion and/or ion-molecule interaction greatly assisted by intermolecular H-bonding. The reactivity of hydroxamate as a flotation reagent probably depends to some extent upon this nature of aggregates. Increasing the pH over pKa of hydroxamic acid (~9) gives rise to improved solubility of the hydroxamate due to ion-ion type aggregate whereas decreasing pH favours ion-molecule type aggregates.

The hydroxamate reagent is prepared so as to get the whole product as the potassium salt of hydroxamic acid form with enhanced solubility in water. When made in approximately 50% paste form, the hydroxamate reagent is found to be well soluble in warm water or preferably diluted KOH (0.5%–1%) and is readily dispersed in the flotation media. As the reagent is transformed from the paste to the dry powder form, its solubility is significantly decreased which we rationalise as part of the salt (ionic form) being reverted back to acid (molecular form) which gives rise to the less soluble ion-molecule type aggregate. When the solid hydroxamate reagent is carefully conditioned with 1% KOH solution, its solubility is greatly enhanced and exhibits characteristic surface active property as good as paste form.

What is claimed is:

1. A method of collecting mineral values from an aqueous ore slurry by froth flotation, the method comprising the step of adding an aqueous fatty hydroxamate composition to the aqueous ore slurry wherein the pH of said aqueous fatty hydroxamate composition is at least 11 and said aqueous fatty hydroxamate composition is essentially free of water insoluble solvents and removing the froth and associated mineral values.

2. A method according to claim 1 wherein the pH of the composition is in the range of from 11 to 13.

3. A method according to claim 1 wherein the pH of the composition is in the range of from 11.5 to 13.

4. A method according to claim 1 wherein the pH of the composition is in the range of from 12.0 to 12.5.

5. A method according to claim 1 wherein the fatty portion of the fatty hydroxamate has a carbon chain length in the range of from 6 to 14 carbon atoms.

6. A method according to claim 5 wherein the fatty portion has a carbon chain length in the range of from 8 to 12 carbon atoms.

7. A method according to claim 6 wherein the fatty portion has a carbon chain length of 8 or 10 carbon atoms, or mixture thereof.

8. A method according to claim 6 wherein the fatty portion of the fatty hydroxamate is sourced from fractionated coconut and palm kernel oil.

9. A method according to claim 1 wherein the aqueous fatty hydroxamate composition contains less than 5% w/w of fatty acid impurity.

10. A method according to claim 1 wherein the counter ion is sodium, potassium or a mixture of sodium and potassium.

11. A method according to claim 1 wherein the counter ion is present in excess.

12. A method according to claim 1 wherein the concentration of the hydroxamate in said aqueous fatty hydroxamate composition is in the range of from 1 to 60% by weight of the aqueous mixture.

13. A method according to claim 1 wherein the concentration of the hydroxamate in said aqueous fatty hydroxamate composition is in the range of from 5 to 50% by weight of the aqueous mixture.

14. A method according to claim 1 wherein the aqueous fatty hydroxamate composition is formulated as a paste comprising 30 to 50% parts by weight of alkali metal hydroxamate and 50 to 70% parts by weight water and optionally, other components.

15. A method according to claim 1 further comprising providing hydroxylamine in the aqueous fatty hydroxamate in an amount of up to 1% by weight of the total aqueous fatty hydroxamate composition.

16. A method of collecting mineral values according to claim 1 wherein the amount of hydroxamate reagent is in the range of 0.1 to 500 g per tonne of ore.

17. A method of collecting mineral values according to claim 1 wherein the hydroxamate composition is added to the slurry as a dilute solution of concentration in the range of from 1 to 30% of hydroxamate salt by weight of the total aqueous hydroxamate composition and mixed for at least 30 minutes before use.

18. A method according to claim 17 wherein the dilute solution of hydroxamate is prepared by diluting a hydroxamate composition with aqueous alkali metal hydroxide.

19. A method according to claim 18 wherein the hydroxamate is diluted with 1% KOH solution.

20. A method of froth flotation of minerals from ore comprising:

(i) forming an aqueous slurry of the ore;

(ii) optionally adjusting the pH of the slurry;

(iii) adding to the slurry an aqueous composition of fatty hydroxamate wherein the pH of the said aqueous fatty hydroxamate composition is at least 11 and said aqueous fatty hydroxamate composition is essentially free of water insoluble solvents;

(iv) agitating the slurry to mix and condition the fatty hydroxamate and ore slurry;

(v) adding a frothing agent to the slurry;

(vi) agitating the slurry to form a froth containing floated minerals; and (vii) removing the froth and collecting the floated minerals in the presence of the hydroxamate.

21. A method of collecting mineral values from an aqueous ore slurry by froth flotation, the method comprising:

forming an aqueous fatty hydroxamate composition by providing an aqueous hydroxylamine free base and combining the hydroxylamine free base with fatty acid ester in the presence of alkali to form a fatty hydroxamate;

adding further alkali to the fatty hydroxamate to provide an aqueous mixture of fatty hydroxamate of pH of at least 11 and said aqueous fatty hydroxamate composition is essentially free of water insoluble solvents; and adding said aqueous fatty hydroxamate composition of pH of at least 11 to the aqueous ore slurry forming a foam in the ore slurry and removing the froth and associated mineral values.

22. A method according to claim 21 wherein the hydroxylamine free base has a concentration in the range of from 10 to 30% by weight.

23. A method according to claim 22 wherein the hydroxylamine free base of concentration in the range of from 10 to 30% by weight is prepared by reaction of alkali metal hydroxide and hydroxyl ammonium sulfate prior to combining the hydroxylamine free base and fatty acid ester.

* * * * *